United States Patent [19]

Peltret

[11] 3,938,487

[45] Feb. 17, 1976

[54] LIQUID FUEL PUMPING APPARATUS

[75] Inventor: Pierre Henri Peltret, London, England

[73] Assignee: C.A.V. Limited, Birmingham, England

[22] Filed: Jan. 25, 1974

[21] Appl. No.: 436,813

[30] Foreign Application Priority Data

Feb. 3, 1973 United Kingdom ..... 5467/73

[52] U.S. Cl. ..... 123/139 ST; 123/179 L

[51] Int. Cl.² ..... F02M 59/42

[58] Field of Search..... 123/140 R, 139 ST, 179 L, 123/179 G

[56] References Cited

UNITED STATES PATENTS

| | | | |
|---|---|---|---|
| 3,311,101 | 3/1967 | Huse | 123/139 R X |
| 3,311,102 | 3/1967 | Voigt | 123/179 L |
| 3,313,283 | 4/1967 | Miller | 123/140 |
| 3,640,259 | 2/1972 | Garcea | 123/140 MC |
| 3,814,072 | 6/1974 | Gillespie | 123/179 L |
| 3,865,091 | 2/1975 | Bostwick et al. | 123/139 ST |

FOREIGN PATENTS OR APPLICATIONS

| | | | |
|---|---|---|---|
| 832,045 | 4/1960 | United Kingdom | 123/139 ST |
| 1,246,641 | 9/1971 | United Kingdom | 123/139 ST |

*Primary Examiner*—Wendell E. Burns
*Assistant Examiner*—Tony Argenbright
*Attorney, Agent, or Firm*—Holman & Stern

[57] ABSTRACT

A fuel pumping apparatus for supplying fuel to an internal combustion engine is provided with a governor mechanism having weights which through linked means effect movement of a control rod to reduce the amount of fuel supplied to the engine. The weights are opposed by a governor spring and a maximum fuel stop is provided to control the normal maximum amount of fuel supplied to the engine. Releasable actuator means is provided to effect movement of the control rod to an excess fuel position, when it is required to start the engine.

5 Claims, 4 Drawing Figures

LIQUID FUEL PUMPING APPARATUS

BACKGROUND OF THE INVENTION

This invention relates to liquid fuel pumping apparatus for supplying fuel to internal combustion engines, the apparatus being of the kind comprising an injection pump operable in timed relationship with an associated engine, a fuel control rod movable to effect adjustment of the quantity of fuel supplied at each injection stroke, governor mechanism including a governor weight which is driven at a speed dependent upon the speed of the associated engine, a member movable by the weight, a governor spring for opposing movement of the member as the speed of the engine increases, operator adjustable means for adjusting the force exerted by the spring and link means connecting said member with the fuel control rod whereby for a given setting of the operator adjustable means, as the engine speed increases, the fuel control rod will be moved to reduce the amount of fuel supplied by the apparatus.

Such apparatus is well known, and there is usually incorporated in the governor mechanism a maximum fuel stop which can be temporarily put out of action to allow the supply of a larger or excess quantity of fuel for starting purposes. The movement of the control rod to effect this adjustment is achieved by firstly moving the maximum fuel stop and secondly by the operator moving the operator adjustable means in a direction to increase the force exerted by the governor spring.

In some forms of apparatus, the procedure described above is not effective to move the fuel control rod to the excess fuel position. This is because, in some forms of apparatus, an additional spring is interposed between the governor spring and said member and the movement of the end of the governor spring which is effectively connected to said additional spring, is limited by a stop. The action of the additional spring is to modify the fuel delivery of the apparatus. The additional spring is a relatively light spring, and is unable to provide sufficient force to effect movement of the fuel control rod to the excess fuel position when the maximum fuel stop is temporarily put out of action.

In other forms of apparatus, an adjustable fuel stop is provided and its position is determined by means of a device in one example, responsive to the pressure of air supplied to the engine air inlet manifold. The device incorporates a strong spring the force of which, even when the additional spring and stop mentioned in the proceeding paragraph is not provided, cannot be overcome by the governor spring. Even with apparatus of the kind specified, it is sometimes difficult to ensure that under all conditions the fuel control rod can be moved to the excess fuel position in the manner described.

OBJECTS AND SUMMARY OF THE INVENTION

The object of the invention is to provide such an apparatus in a simple and convenient form, and in which the selection of excess fuel for starting purposes is facilitated.

According to the invention, in an apparatus of the kind specified, a releasable actuator is provided, said actuator when released, acting to effect movement of the control rod to the excess fuel position.

According to a further feature of the invention, fluid pressure operable means is provided to reset the actuator when excess fuel is no longer required.

One example of a fuel pumping apparatus in accordance with the invention will now be described with reference to the accompanying drawings in which:

DETAILED DESCRIPTION OF THE PREFERRED EMBODIMENT

Figure 1:
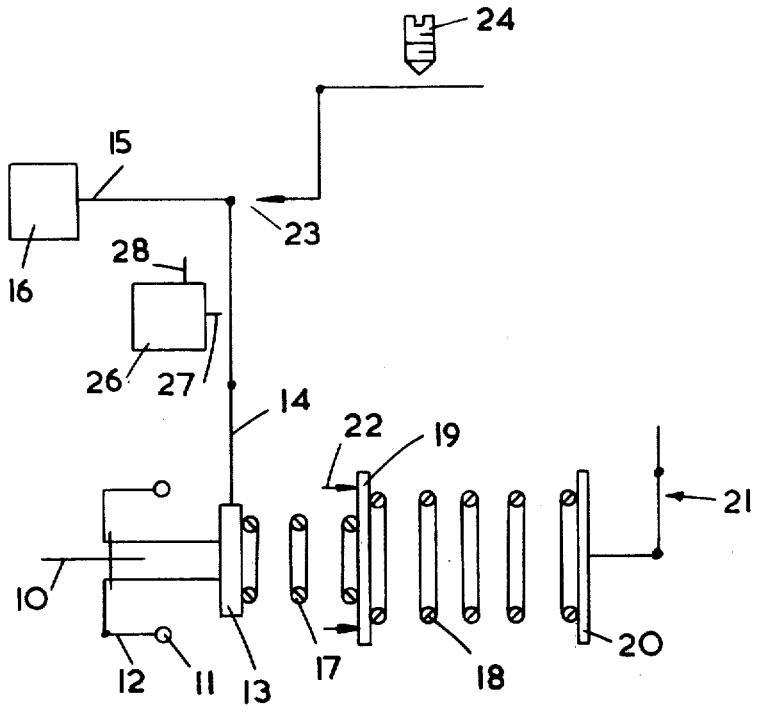
FIG. 1 is a diagrammatic illustration of the apparatus.

FIG. 1 as mentioned, illustrates in diagrammatic form one example of an apparatus in accordance with the invention. Referring to FIG. 1, there is provided a drive shaft 10 upon which is mounted a cage (not shown) incorporating a plurality of governor weights 11. The governor weights are mounted on bell crank levers 12, and as the weights move outwardly, axial movement is imparted to a member 13. The member 13 is connected by means of a pivotal lever 14 to a fuel control rod 15 of a fuel pump shown at 16. As the weights move outwardly, the member 13 together with the lever 14 effect movement of the fuel control rod in a direction to decrease the quantity of fuel supplied at each injection stroke of the apparatus.

Movement of the member 13 is resisted by a pair of springs 17, 18 and interposed between the springs is a spring abutment 19. The spring 18 is the governor spring and at its end remote from the abutment 19, it bears against a further abutment 20, the position of which is determined by a linkage 21 which in use, is connected to an operator control member, such for instance, as a throttle pedal.

When the operator adjustable means is moved to increase the force exerted by the governor spring, axial movement is imparted to the member 13, and the lever 14 is moved in a direction to increase the quantity of fuel supplied by the engine. During this movement, the weights are compressed, but as the speed of the engine increases, the weights will again move outwardly to reduce the quantity of fuel supplied. The movement of the abutment plate 19 when the operator adjustable means is moved to increase the force exerted by the governor spring 18, is limited by means of stops 22. The spring 17 is provided for the purpose of shaping the speed/fuel characteristic of the apparatus and provides above a predetermined speed, a drooping characteristic.

In the example shown in FIG. 1, the maximum quantity of fuel which can be supplied to the engine at any particular time is determined by means of a stop 23 which is set by a screw 24 or it may be adjustable by means (not shown) responsive to the pressure of air supplied to the air inlet manifold of the engine.

When excess fuel is required for starting purposes, it is necessary to move the control rod 15 an additional amount, and usually this is effected in apparatus which does not incorporate the abutment 19, additional spring 17 and stops 22, by moving the stop represented by 23 and then moving the abutment 20 so that the force exerted by the spring 18 is increased. This has the effect of moving the fuel control rod to an excess fuel position. In the apparatus described, however, it will be seen that the force exerted by the spring 18 on the lever 14 is limited by the fact that the abutment 19 contacts the stops 22, and the strength of the spring 17 is insufficient to reliably collapse the governor weights 11 and move the lever 14, together with the control rod 15 to an excess fuel position. This applies when a fixed maximum fuel stop is provided, and which is moved out of the way when excess fuel is required, and it applies particularly in the case in which such movement of the lever 14 must also be against the action of a spring contained in a maximum fuel control device. In order to overcome this difficulty, an actuator 26 is provided and this incorporates a movable member 27 for abutment with the lever 14 and a release means 28. The actuator contains a strong spring, and when the release means is released, the member 27 is moved into contact with the lever 14 and effects movement of the lever 14 so that excess of fuel for starting purposes is provided.

Figure 2:
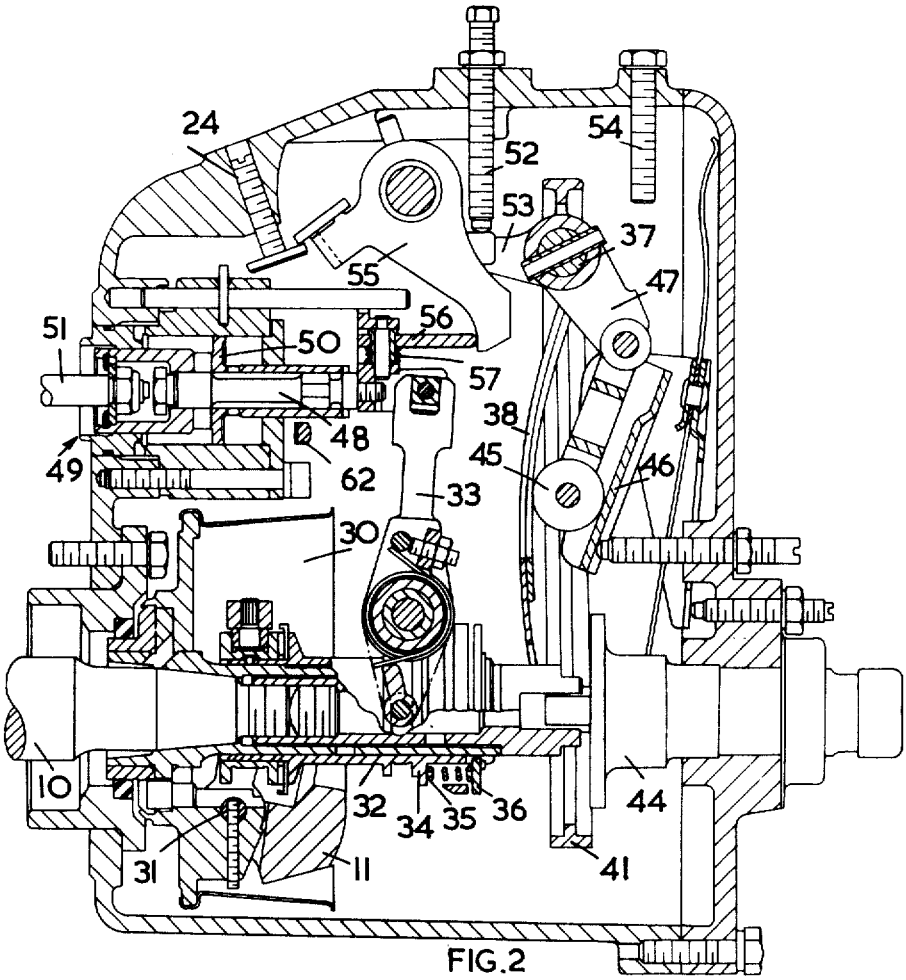
FIG. 2 is a sectional side elevation of a practical form of the apparatus.
Figure 3:
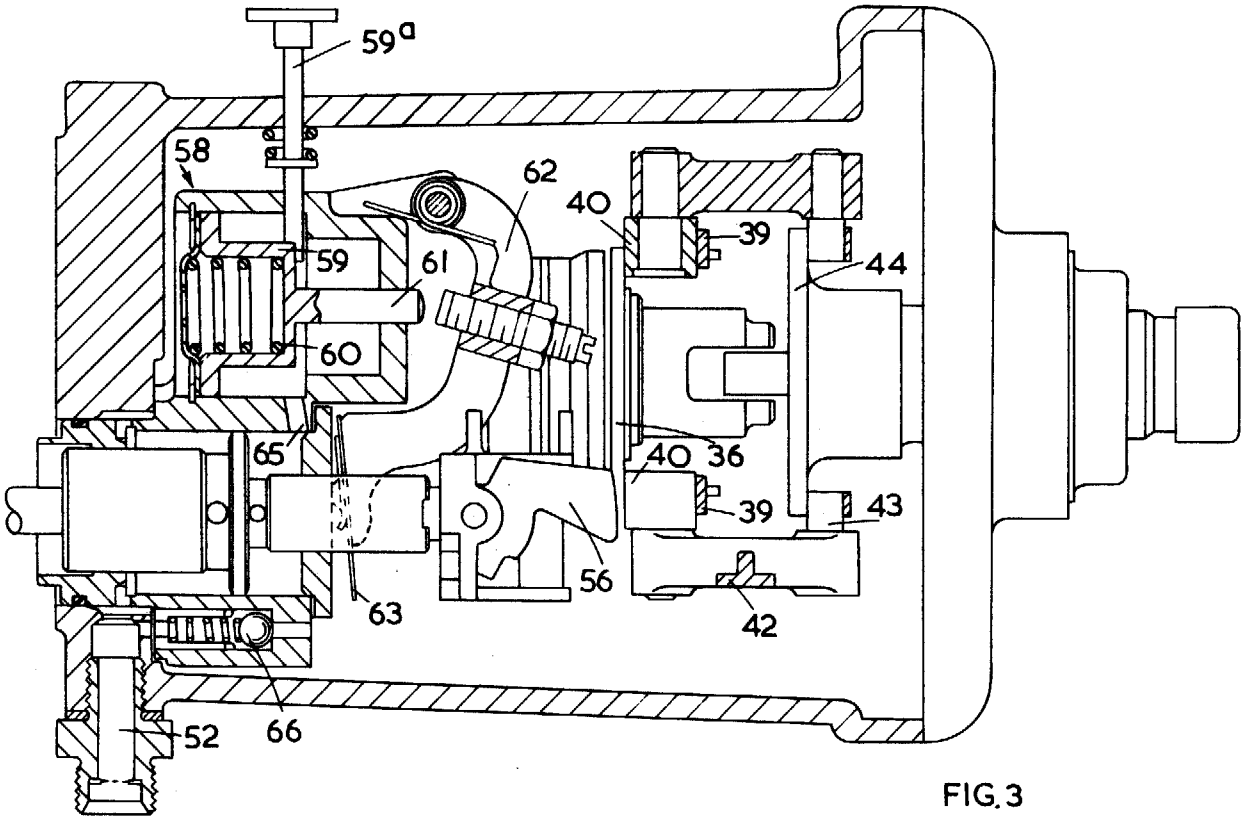
FIG. 3 is a plan view of the apparatus of FIG. 2 with parts removed for the sake of clarity.
Figure 4:
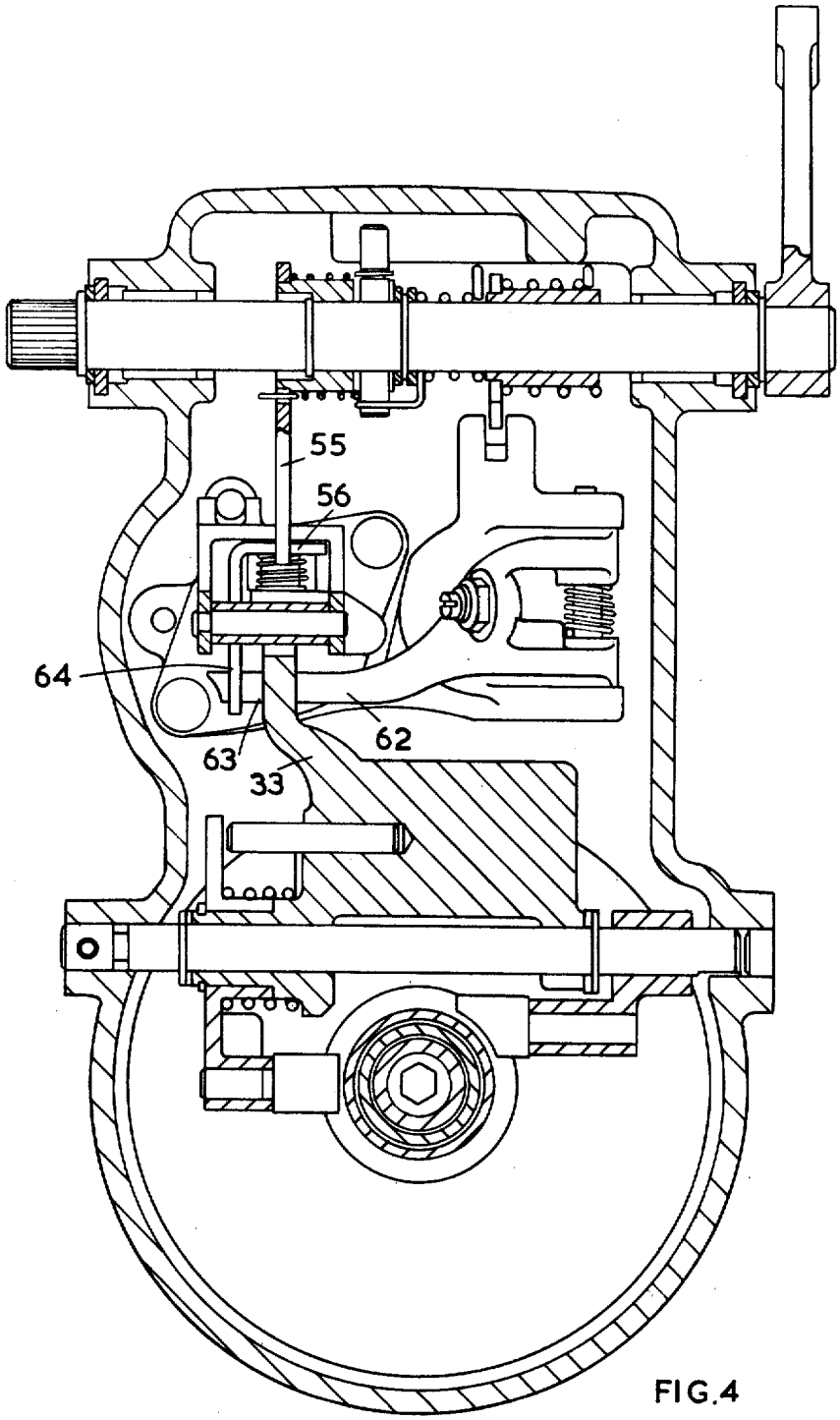
FIG. 4 is a sectional end elevation of the pump shown in FIGS. 2 and 3 again with parts removed.

Reference is now made to FIGS. 2 and 3 which show a practical embodiment of the apparatus described with reference to FIG. 1. With reference to FIGS. 2 and 3, the drive shaft is again indicated at 10, and this is coupled to a cage 30 which encloses the governor weights 11. One only of these weights is illustrated, and it is pivotally mounted about an axis 31. The weight effects axial movement of a sleeve 32 which is the equivalent of the member 13 and the sleeve 32 is connected to a pivotal lever 33 which is equivalent to the lever 14. In addition, the sleeve is provided with a flange 34 against which bears a coiled compression spring 35 which is the equivalent of the spring 17. The other end of the coiled compression spring bears against an abutment plate 36 which is the equivalent of the abutment 19.

Mounted about a pivot axis 37 is a leaf spring 38 and this has bifurcated end portions 39 which bear against rollers 40 respectively, which in turn engage the abutment plate 36. The rollers 40 are carried upon a beam 41 which is pivotally mounted about the axis 37. At its lower end, the beam is provided with generally axially extending portions 42 which carry the rollers 40 and which also carry abutment pegs 43 which can engage with a flanged sleeve 44 to limit the extent of movement of the beam 41 under the action of the spring 38. The abutment pegs 43 are the equivalent of the stops 22 shown in FIG. 1.

The force exerted by the spring 38 is determined by means of a manually adjustable roller 45, which is movable along a ramp 46. The roller 45 is connected to linkage including a lever 47 which is mounted upon a pin constituting the axis 37, with the pin extending to the exterior of the housing and mounting a further lever which, in use, is connected to the driver's throttle control of the vehicle. When the driver requires an increase in the engine speed, the roller 45 is moved downwardly as shown in FIG. 2 to increase the force exerted by the spring 38. This has the effect of moving the sleeve 32 together with the lever 33 in a direction so that the lever 33 moves in the clockwise direction. The end of the lever 33 remote from the sleeve 32 is connected to the valve element 48 of a servo 49, the latter including a piston 50 which is connected to a control rod 51 of the pumping apparatus. The valve element 48 is accommodated within the piston 50 and it acts when the apparatus is in use, as a follow-up servosystem. The fluid under pressure for actuating the servo is supplied to the apparatus through an inlet 52 from a convenient source of pressure on the associated engine.

The maximum demand which can be made by the driver is determined by a stop 52 which is contacted by an arm 53 secured to the pin constituting the axis 37. As shown, the apparatus is set to provide the maximum demand. In addition, an idling stop 54 is provided and this is contacted by a surface defined upon the lever 47.

The maximum fuel stop is constituted by a pivotal plate 55, the position of which is preset by means of the screw 24, and is engaged by an arm 56 forming part of an assembly carried by the valve element 48. As shown in FIGS. 2 and 3, the arm 56 is engaging at the plate 55, or in other words, the maximum fuel stop is operative to limit the amount of fuel which can be supplied to the engine. The arm is spring loaded to the position in which it is shown in FIG. 3 by means of a coiled tension spring 57, and is movable in an anti-clockwise direction, as seen in FIG. 3, to permit the fuel control rod to move towards the excess fuel position.

As shown in FIG. 3, an actuator 58 is provided, and which is the equivalent of the actuator 26 shown in FIG. 1. The actuator 58 includes a cup shaped piston element 59, which accommodates a coiled compression spring 60. The piston element includes an extension 61 for engagement with an angularly movable arm 62. The arm 62, when the actuator is released, is moved angularly in an anti-clockwise direction as shown in FIG. 3. The arm 62 has a main body portion which can engage with the lever 33, but at its end, it is provided with a leaf spring 63 positioned for engagement with an arm 64 formed integrally with the arm 56. When the actuator is released, the arm 62 is moved angularly about its axis until a point is reached at which the leaf spring 63 engages the arm 64. Further movement of the arm 62 effects angular movement in an anti-clockwise direction as seen in FIG. 3, of the arm 56 thereby moving the latter out of engagement with the plate 55. Continued movement of the arm 62 brings it into engagement with the lever 33, and when this occurs, the lever 33 is moved angularly so that the control rod is moved to the excess fuel position. The strength of the spring 60 is chosen so that it can perform this task even if a maximum fuel control device containing springs is provided.

In order to release the piston element 59, a spring loaded pin **59*a* is provided and which engages with the base wall of the piston element. The pin 59*a* is retractable by means operable from the exterior of the apparatus. The piston element 59 is returned to the position in which it is shown in FIG. 3 by means of hydraulic pressure, which is supplied to the cylinder containing the piston element through a passage 65. The passage 65 communicates with the right hand side of the piston 50 which, when the associated engine is started, is supplied with oil under pressure by the fact that the valve element 48 is moved by the lever 33 to admit fluid under pressure to this side of the piston. Both the piston element 59 and the piston 50 will therefore be subjected to fluid pressure, and the piston element 59 will be returned to the position in which it is shown in FIG. 3. During the return movement, the pin 59*a* moves into a position to intercept the return motion of the piston element 59 so that excess fuel is only selected when required by the operator or driver. It will also be observed that in the event the supply of fluid under pressure fails, then the lever 33 by its abutment with the arm 62 as the engine speed increases, can also effect movement of the piston element towards the position in which it is shown in FIG. 3 and sufficient to ensure that it assumes a latched state. During movement of the piston element by the governor, fluid will be drawn into the cylinder which contains the element. This is permitted by the provision of a one way valve 66 which can open in such circumstances, but which normally remains closed. When the release means is withdrawn out of the path of the piston element 59, fluid is displaced from its cylinder by way of the passage 65, and this fluid exerts a pressure on the piston 50 which will move it relative to the valve element 48. Such relative movement permits fluid to escape from the portion of the cylinder at the right hand side of the piston 50 and therefore the piston element 59** is free to perform the duty outlined above.

I claim:

1. A liquid fuel pumping apparatus for supplying fuel to an internal combustion engine, comprising an injection pump operable in time relationship with an associated engine, a fuel control rod movable to effect adjustment of the quantity of fuel supplied at each injection stroke, governor mechanism including a governor weight which is driven at a speed dependent upon the speed of the associated engine, a member movable by the weight, a governor spring for opposing movement of the member as the speed of the engine increases, operator adjustable means for adjusting the force exerted by the spring, link means connecting said member with the fuel control rod whereby for a given setting of the operator adjustable means, as the engine speed increases, the fuel control rod will be moved to reduce the amount of fuel supplied to the apparatus, a releasable actuator which, when released, acts to effect movement of the control rod to an excess fuel position, said actuator including a coiled compression spring, a piston which can be subjected to fluid pressure in order to compress the spring, a spring loaded pin to retain the piston, with the pin being operable from the exterior of the apparatus when excess fuel is required, a pivotal arm which can be engaged by said piston when said pin is released, with said arm pivoting under the action of said compression spring and engaging with part of said link means to effect movement of the control rod to the excess fuel position, a maximum fuel stop which acts to limit the movement of the control rod in the direction of increasing fuel during normal operation of the apparatus, and said pivotal arm having means for rendering said maximum fuel stop inoperative prior to the engagement of the arm with said part of the link means.

2. The apparatus as claimed in claim 1 including a pivotal member mounted on a part movable with the control rod, in which said means comprises a leaf spring mounted on the arm, with said leaf spring being positioned to engage said pivotal member mounted on a part movable with the control rod, said pivotal member, during normal operation of the appartus, engaging said stop to control the maximum amount of fuel supplied by the apparatus, said leaf spring when the arm is moved engaging said pivotal member thereby rendering said maximum fuel stop inoperative and allowing the control rod to move to the excess fuel position.

3. The apparatus as claimed in claim 1 including a cylinder containing said piston, in which said piston can be moved against the action of the coiled compression spring to a latched position by the action of said weight in the event the supply of fluid under pressure to the cylinder containing the piston fails.

4. The apparatus as claimed in claim 3 including a nonreturn valve which can open to permit movement of the piston by the weight.

5. The apparatus as claimed in claim 4 including a fluid pressure operable servo for effecting movement of the control rod, with said servo including a servo valve, the setting of which is determined by said link means.

* * * * *